US010495390B2

(12) United States Patent
Huang

(10) Patent No.: US 10,495,390 B2
(45) Date of Patent: Dec. 3, 2019

(54) LIQUID COOLING RADIATOR WITH IMPURITIES FILTERING

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 107 days.

(21) Appl. No.: 15/968,844

(22) Filed: May 2, 2018

(65) Prior Publication Data

US 2019/0242661 A1 Aug. 8, 2019

(30) Foreign Application Priority Data

Feb. 8, 2018 (CN) ..... 2018 1 0127658

(51) Int. Cl.

| | |
|---|---|
| ***F28F 19/01*** | (2006.01) |
| ***F28D 1/053*** | (2006.01) |
| ***F28F 9/02*** | (2006.01) |
| ***F28F 9/16*** | (2006.01) |

(52) U.S. Cl.

CPC ..... *F28F 19/01* (2013.01); *F28D 1/05325* (2013.01); *F28F 9/0202* (2013.01); *F28F 9/0224* (2013.01); *F28F 9/0282* (2013.01); *F28F 9/16* (2013.01); *F28F 2275/122* (2013.01)

(58) Field of Classification Search

CPC ..... F28F 19/01; F28F 9/0202; F28F 9/0224; F28F 9/0282; F28F 9/16; F28F 2275/122; F28D 1/05325; H05K 7/20272

See application file for complete search history.

(56) References Cited

U.S. PATENT DOCUMENTS

| | | | | | |
|---|---|---|---|---|---|
| 282,804 | A * | 8/1883 | Thompson | F28F 19/01 | 165/119 |
| 317,011 | A * | 5/1885 | Porter | E04D 13/0767 | 210/162 |
| 441,497 | A * | 11/1890 | Leland | F28F 19/01 | 165/119 |
| 1,554,924 | A * | 9/1925 | Shapiro | F01P 7/08 | 165/119 |
| 2,082,866 | A * | 6/1937 | Alexander | F01P 11/06 | 165/71 |
| 2,118,344 | A * | 5/1938 | Erickson | B60K 11/04 | 210/497.01 |

(Continued)

FOREIGN PATENT DOCUMENTS

| | | |
|---|---|---|
| TW | M418325 | 12/2011 |
| TW | M537247 | 2/2017 |
| TW | I607533 | 12/2017 |

*Primary Examiner* — Ljiljana V. Ciric

(74) *Attorney, Agent, or Firm* — Pai Patent & Trademark Law Firm; Chao-Chang David Pai

(57) ABSTRACT

A liquid cooling radiator with impurities filtering includes a radiation fin module, a top cover and a bottom cover respectively enclosed at two opposite ends of the radiation fin module, liquid cooling heat dissipation pipes tightly inserted through the radiation fin module in communication between an enclosed top chamber in the top cover and an enclosed bottom chamber in the bottom cover for coolant circulation, and wire gauge filters individually mounted in the liquid cooling heat dissipation pipes for removing impurities from the circulating coolant and slowing down the flowing speed of the circulating coolant.

8 Claims, 6 Drawing Sheets

(56) References Cited

U.S. PATENT DOCUMENTS 2,121,708 A * 6/1938 Miguel ..... F28F 19/01 165/119
2,149,065 A * 2/1939 Miguel ..... F28D 1/0358 165/119
2,229,032 A * 1/1941 Ashley ..... F28D 1/053 165/142
3,191,672 A * 6/1965 Logan ..... F01P 11/06 165/119
3,279,608 A * 10/1966 Levendusky ..... B01D 29/15 210/232
3,503,516 A * 3/1970 Harms ..... B01D 29/15 210/323.2
3,642,141 A * 2/1972 Hobson, Jr. ..... B01D 29/15 210/323.2
3,675,777 A * 7/1972 Heskett ..... B01D 29/111 210/232
3,682,308 A * 8/1972 Moon ..... B01D 35/153 210/136
3,690,373 A * 9/1972 Wright ..... F28F 3/083 165/119
3,750,889 A * 8/1973 Acosta ..... B01D 29/19 210/497.01
3,850,813 A * 11/1974 Pall ..... B01D 29/111 210/232
4,287,067 A * 9/1981 Dyner ..... B01D 29/117 165/119
4,309,287 A * 1/1982 Roos ..... B01D 61/10 210/247
4,373,578 A * 2/1983 Saperstein ..... F28F 9/0234 165/141
4,382,465 A * 5/1983 Baron ..... F28G 1/125 134/166 C
4,397,349 A * 8/1983 Baron ..... F28G 1/125 15/3.51
4,489,776 A * 12/1984 Baron ..... F28G 1/125 15/3.51
4,579,659 A * 4/1986 Eades ..... B01D 24/12 210/541
4,590,994 A * 5/1986 Champion ..... F28F 19/01 165/119
4,690,208 A * 9/1987 Deck ..... F24D 17/001 165/119
4,713,174 A * 12/1987 Zievers ..... B01D 29/114 210/233
4,743,369 A * 5/1988 Geermans ..... B01D 29/27 210/167.29
4,849,104 A * 7/1989 Garcera ..... B01D 63/061 210/323.2
4,906,362 A * 3/1990 Holm ..... A23C 9/1422 210/196
5,102,537 A * 4/1992 Jones ..... E03F 7/06 138/96 R
5,281,331 A * 1/1994 Golan ..... B01D 35/02 123/41.04
5,307,868 A * 5/1994 Barbaud ..... F28F 3/083 165/103
5,401,406 A * 3/1995 Johnson ..... B01D 29/33 210/323.2
5,509,467 A * 4/1996 Gibbs ..... F28F 19/01 165/119
5,554,283 A * 9/1996 Brinda ..... B01D 63/02 210/321.8
5,806,586 A * 9/1998 Osthues ..... F28F 9/0273 165/153
5,906,739 A * 5/1999 Osterland ..... B01D 61/14 210/321.78
5,950,715 A * 9/1999 Jonsson ..... F28D 9/005 165/103
6,267,881 B1 * 7/2001 Covington ..... B01D 29/016 210/167.32
6,749,747 B1 * 6/2004 Olapinski ..... B01D 35/18 210/184
7,287,575 B2 * 10/2007 Andersson ..... F28F 3/083 165/119
9,709,341 B2 * 7/2017 Naruse ..... F24H 8/00
9,718,023 B2 * 8/2017 Kanetsuki ..... B01D 53/228
10,096,537 B1 * 10/2018 Chen ..... H01L 23/427
2002/0041486 A1 * 4/2002 Hildebrandt ..... H01L 23/427 361/700
2004/0134637 A1 * 7/2004 Helin ..... F28D 9/005 165/11.1
2005/0126770 A1 * 6/2005 Higashiyama ..... F25B 39/022 165/174
2005/0236146 A1 * 10/2005 Busse ..... F25B 39/04 165/140
2008/0253085 A1 * 10/2008 Soffer ..... G06F 1/18 361/679.4
2009/0236761 A1 * 9/2009 Gembolis ..... F28D 1/04 261/5
2010/0199840 A1 * 8/2010 Yamaoka ..... B01D 53/22 95/50
2012/0255706 A1 * 10/2012 Tadayon ..... F28D 20/0039 165/47
2014/0102680 A1 * 4/2014 Lee ..... F28F 19/01 165/148
2015/0138723 A1 * 5/2015 Shedd ..... H05K 7/20809 361/679.47
2016/0288278 A1 * 10/2016 Cavanaugh ..... B23P 15/26
2018/0224221 A1 * 8/2018 Kennedy ..... F28D 1/05383

* cited by examiner

LIQUID COOLING RADIATOR WITH IMPURITIES FILTERING

BACKGROUND OF THE INVENTION

(a) Field of the Invention

The present invention relates to liquid cooling radiator technology and more particularly to liquid cooling radiator with impurities filtering that has wire gauge filters mounted in the liquid cooling heat dissipation pipes for removing impurities from the circulating coolant and slowing down the flowing speed of the circulating coolant.

(b) Description of the Prior Art

Due to improved performance, electronic devices increase the temperature during operation. Conventional heat dissipation technology generally uses a combination of a heat dissipation module (radiator), isothermal vapor chamber, heat spreaders and/or heat dissipation pipes for dissipating heat from electronic components. A cooling fan can be added to enhance heat dissipation.

Conventionally, the application of a heat dissipating apparatus using heat dissipation pipes combined with a radiation fin module for dissipating heat from electronic components is achieved by keeping the heat dissipation pipes and the radiation fins of the radiation fin module in direct contact with the electronic components. Taiwan Patent Utility M418325 discloses a similar design.

According to conventional heat dissipation technology, the heat dissipation apparatus is mounted inside the electronic equipment to carry heat away from the electronic components. This arrangement cannot directly discharge heat out of the electronic equipment. Therefore, there are also liquid cooling modules applied to electronic devices for heat dissipation. It is known that the liquid cooling radiator technology mainly uses a coolant (working fluid) to flow in liquid cooling heat dissipation pipes so that the heat of the radiation fin module can be continuously circulated and dissipated to cool down the electronic device. Similar designs are seen in Taiwan Utility M537247 and Taiwan Patent I607533. However, during the operation of a conventional liquid cooling radiator, the coolant that is repeatedly circulating through the liquid cooling heat pipes can carry impurities, lowering the heat dissipation performance and causing damage to the electronic components that are kept in direct contact with the coolant. Further, due to fast flow rate of the coolant in the liquid cooling heat dissipation pipes, the staying process of the coolant is short-lived, and the heat temperature cannot be effectively taken away, resulting in a poor overall heat dissipation performance.

SUMMARY OF THE INVENTION

The present invention has been accomplished under the circumstances in view. It is the main object of the present invention to provide a liquid cooling radiator, which comprises a radiation fin module including an array of radiation fins, a top cover covering one end of the radiation fin module and defining therein an enclosed top chamber that is divided by a partition plate into a liquid inlet chamber and a liquid outlet chamber, a liquid inlet nozzle and a liquid outlet nozzle installed in the top cover and respectively disposed in communication with the liquid inlet chamber and the liquid outlet chamber for the liquid inlet nozzle to guide the coolant into the liquid inlet chamber and for the liquid outlet nozzle to guide the coolant out of the liquid outlet chamber, a bottom cover covering an opposite end of the radiation fin module defining therein an enclosed bottom chamber, a plurality of liquid cooling heat dissipation pipes tightly inserted through the radiation fin module with opposing top and bottom ends thereof respectively disposed in communication with the top chamber and the bottom chamber; and at least one wire gauge filter individually press-fitted in the liquid cooling heat dissipation pipes for removing solid matters from a coolant being circulated through the top chamber, the liquid cooling heat dissipation pipes and the bottom chamber and slowing down the flowing speed of the circulating coolant.

Preferably, the top cover and the bottom cover are respectively covered with a packing panel. Each packing panel comprises an upright flange extended around the periphery thereof and press-fitted into the top chamber or bottom chamber, and a plurality of raised pipe mounting holes disposed in communication with the top chamber or bottom chamber. Further, the opposing top and bottom ends of the liquid cooling heat pipes are respectively inserted into the raised pipe mounting holes of the packing panels and respectively riveted into a respective expanded holding-down portion. Thus, the installation of the liquid cooling heat pipes can be rapidly achieved without solder paste bonding. The liquid cooling heat pipes are arranged in two groups, those with their top ends in communication with the liquid inlet chamber (i.e. on the inlet side) and those with their top ends in communication with the liquid outlet chamber (i.e. on the outlet side).

Preferably, the wire gauge filter is in the form of a U-shaped semi-spherical plug and individually press-fitted into the orifice of the flow passage in one respective liquid cooling heat dissipation pipe. The wire gauge filter is not only simple but also facilitates installation.

Further, each wire gauge filter is preferably mounted in one respective liquid cooling heat dissipation pipe on the liquid outlet side and directly disposed in communication with the bottom chamber. After entering the top chamber, the circulating coolant is guided by the liquid cooling heat dissipation pipes to flow through the at least one wire gauge filter where the at least one wire gauge filter removes impurities from the circulating coolant and slows down the flowing speed of the circulating coolant.

Other advantages and features of the present invention will be fully understood by referring to the following specification in conjunction with the accompanying drawings, in which like reference signs denote like components of structure.

DETAILED DESCRIPTION OF THE PREFERRED EMBODIMENTS

Figure 1:
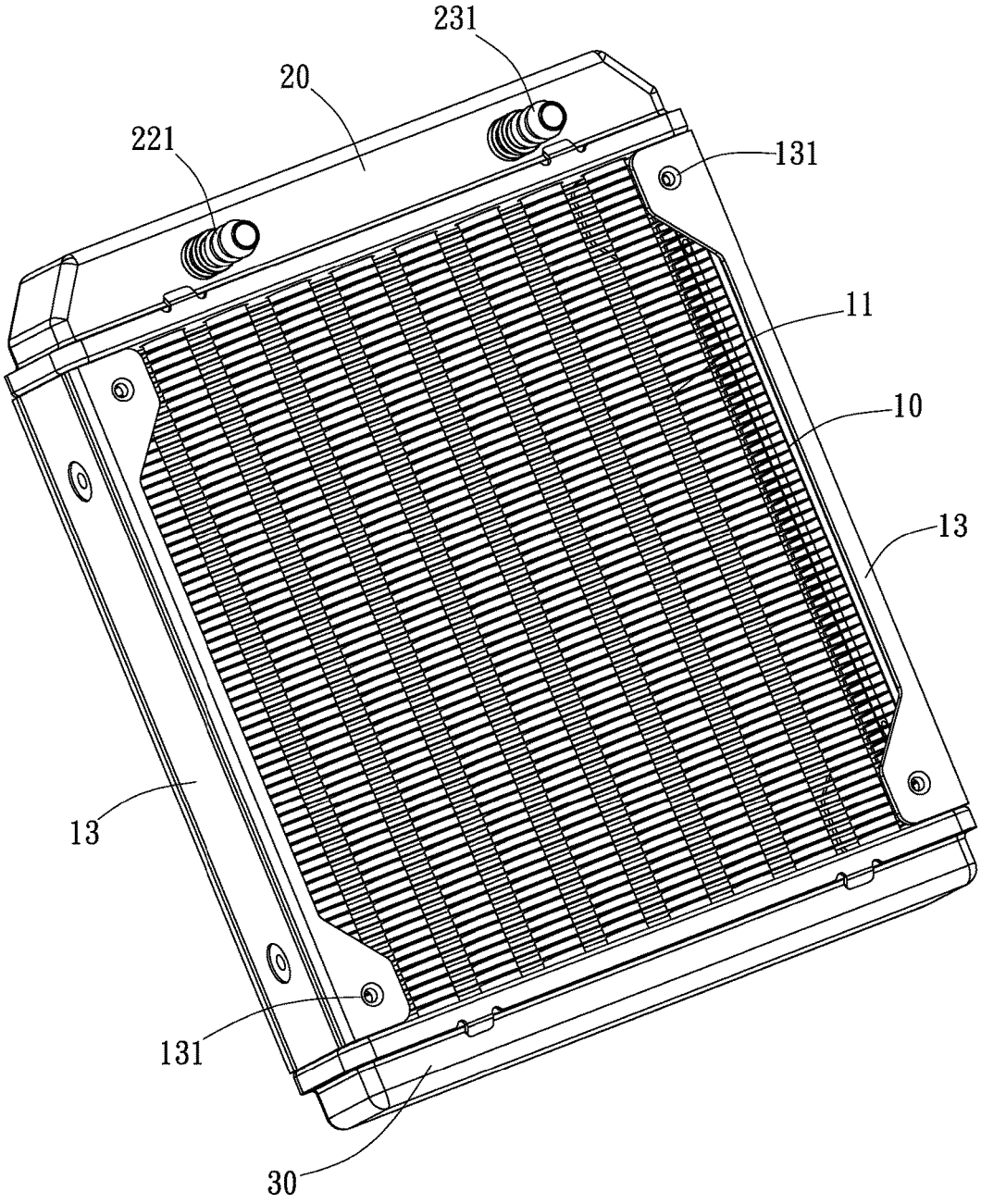
FIG. 1 is an oblique top elevational view of a liquid cooling radiator in accordance with the present invention.
Figure 2:
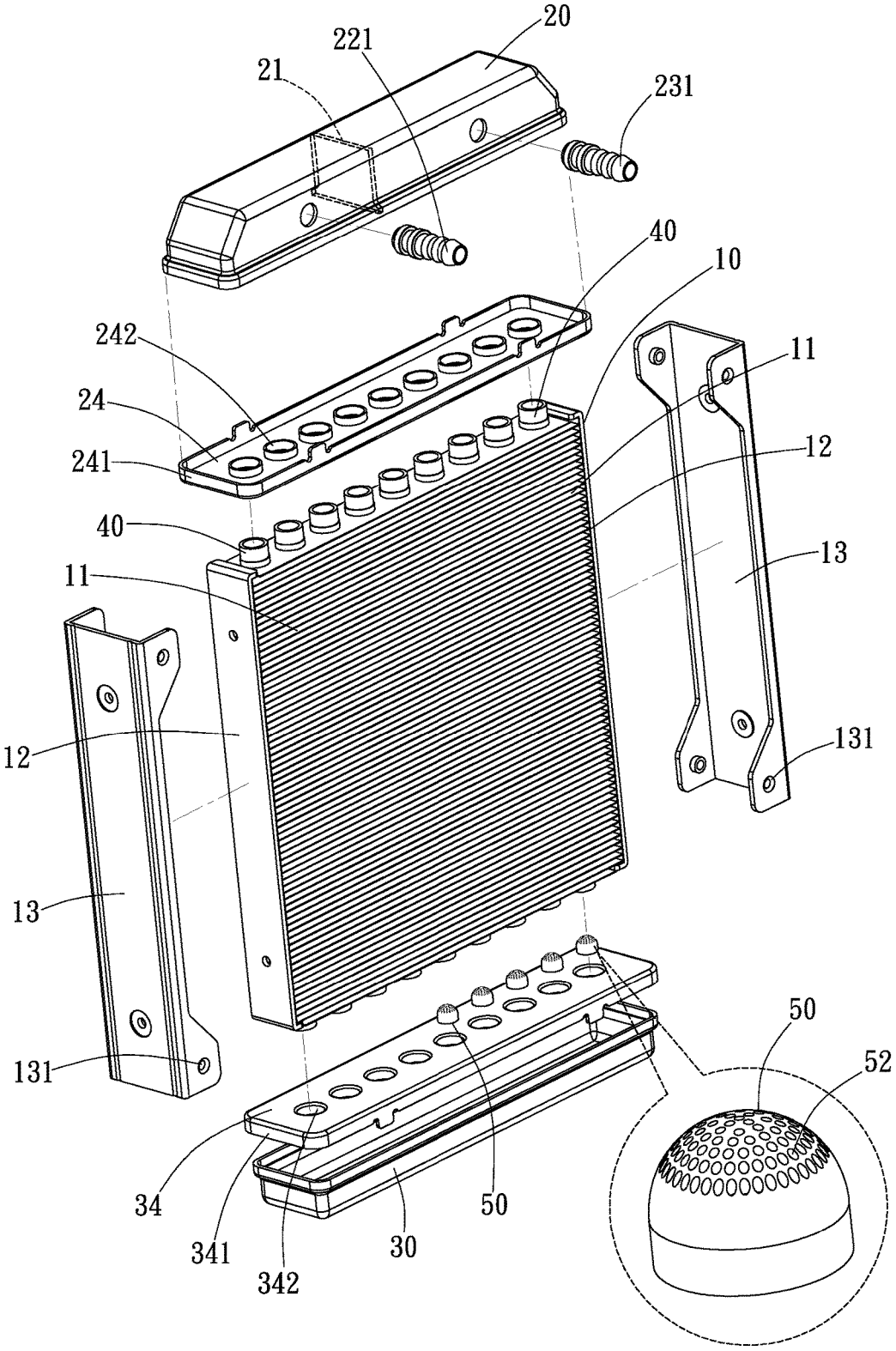
FIG. 2 is an exploded view of the liquid cooling radiator in accordance with the present invention.
Figure 3:
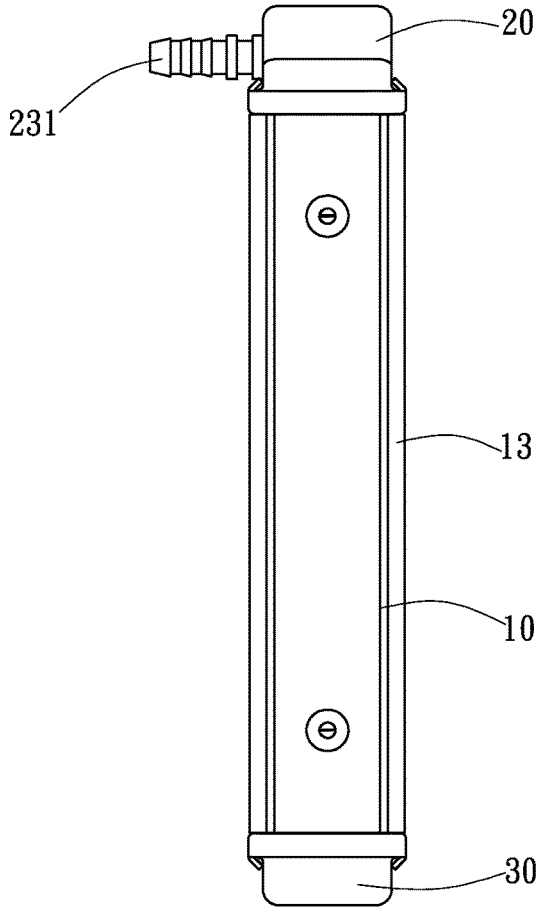
FIG. 3 is a sectional side view of the liquid cooling radiator in accordance with the present invention.
Figure 4:
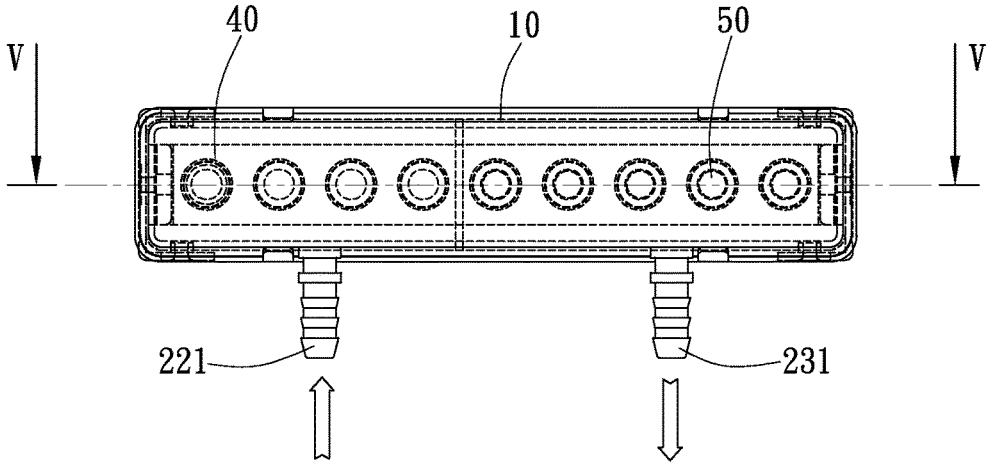
FIG. 4 is a bottom view of the liquid cooling radiator in accordance with the present invention after removal of the bottom cover.

Referring to FIGS. 1-5, a liquid cooling radiator with impurities filtering in accordance with the present invention is shown. The liquid cooling radiator comprises a radiation fin module 10, a top cover 20, a bottom cover 30, a plurality of liquid cooling heat dissipation pipes 40 and at least one wire gauge filter 50.

The radiation fin module 10 comprises a plurality of radiation fins 11 arranged in an array.

The top cover 20 covers one end of the radiation fin module 10, defining with the radiation fin module 10 an enclosed top chamber 201 therebetween. The top chamber 201 is divided into a liquid inlet chamber 22 and a liquid outlet chamber 23 by a partition plate 21. Further, a liquid inlet nozzle 221 and a liquid outlet nozzle 231 are installed in the top cover 20 and respectively disposed in communication with the liquid inlet chamber 22 and the liquid outlet chamber 23 for guiding liquid into or out of the liquid outlet chamber 23.

The bottom cover 30 covers an opposite end of the radiation fin module 10, defining with the radiation fin module 10 an enclosed bottom chamber 301 therebetween.

The liquid cooling heat dissipation pipes 40 are tightly inserted through the radiation fin module 10, each having a top end 401 and an opposite bottom end 402 respectively disposed in communication with the top chamber 201 and the bottom chamber 301. The liquid cooling heat dissipation pipes are arranged in two groups: the inlet side liquid cooling heat dissipation pipes 40A, i.e. those having their respective top ends 401 in communication with the liquid inlet chamber 22, and the outlet side liquid cooling heat dissipation pipes 40B, i.e. those having their top ends 401 in communication with the liquid outlet chamber 23.

Figure 5:
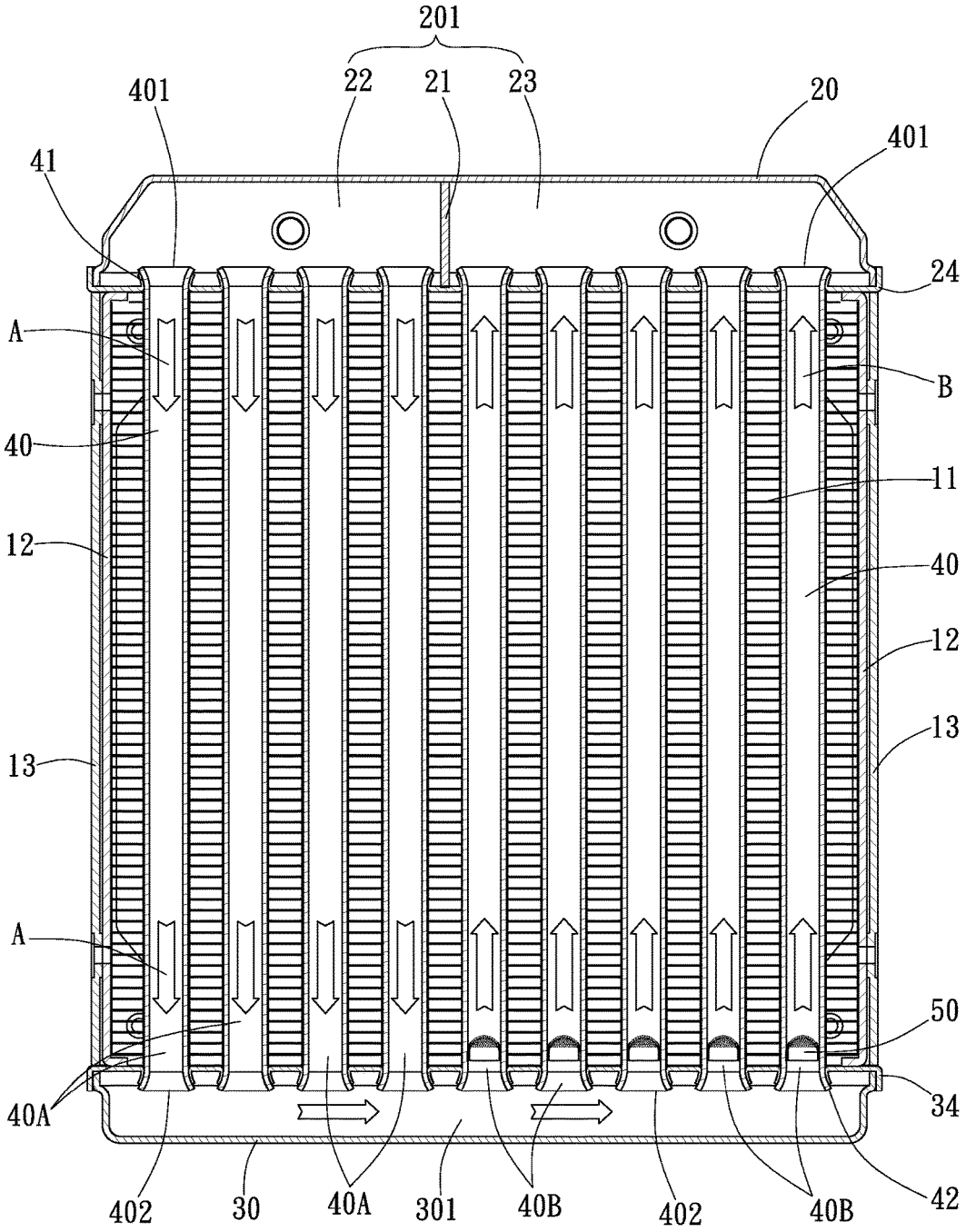
FIG. 5 is a sectional view of the liquid cooling radiator in accordance with the present invention.

The wire gauge filter 50 is a filter member made in the shape of a U-shaped semi-spherical plug plugged into one end of the flow passage in one liquid cooling heat dissipation pipe 40 and fixedly secured to the orifice of the flow passage. In one application example, as shown in FIG. 5, each wire gauge filter 50 is mounted in one respective liquid cooling heat pipe 40 on the liquid outlet side and is disposed in communication with the bottom chamber 301.

In application of the liquid cooling radiator with impurities filtering, the applied coolant is filled into the liquid inlet chamber 22 of the top chamber 201 and guided through the liquid cooling heat dissipation pipes 40 in direction A into the bottom chamber 301 and filtered by the at least one wire gauge filter 50 to remove impurities from the coolant, preventing impurities from affecting the heat dissipation performance. After passing through the at least one wire gauge filter 50, the coolant is guided to the liquid outlet chamber 23 of the top chamber 201 in direction B. At this time, the flowing speed of the coolant is reduced, therefore, the coolant stays in the liquid cooling radiator for a longer time, and the overall heat dissipation effect can be enhanced.

Further, the liquid inlet nozzle 221 and the liquid outlet nozzle 231 are respectively installed in the liquid inlet chamber 22 and liquid outlet chamber 23 of the enclosed top chamber 201 of the top cover 20 to guide in the coolant or to guide out the coolant, enabling the coolant to be repeatedly circulated through the liquid cooling radiator.

Figure 6:
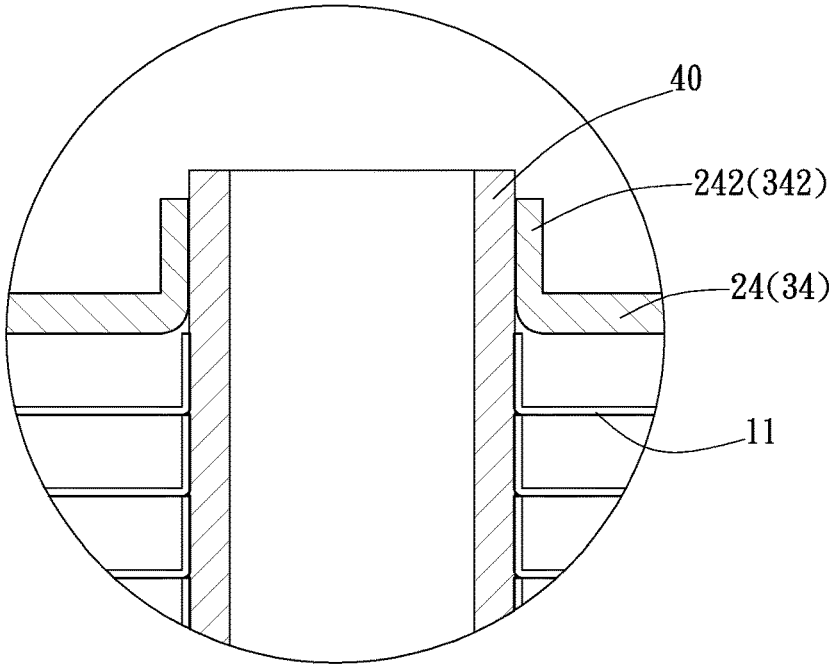
FIG. 6 is a schematic sectional view illustrating the liquid cooling heat dissipation pipe inserted through the packing panel before riveting.
Figure 7:
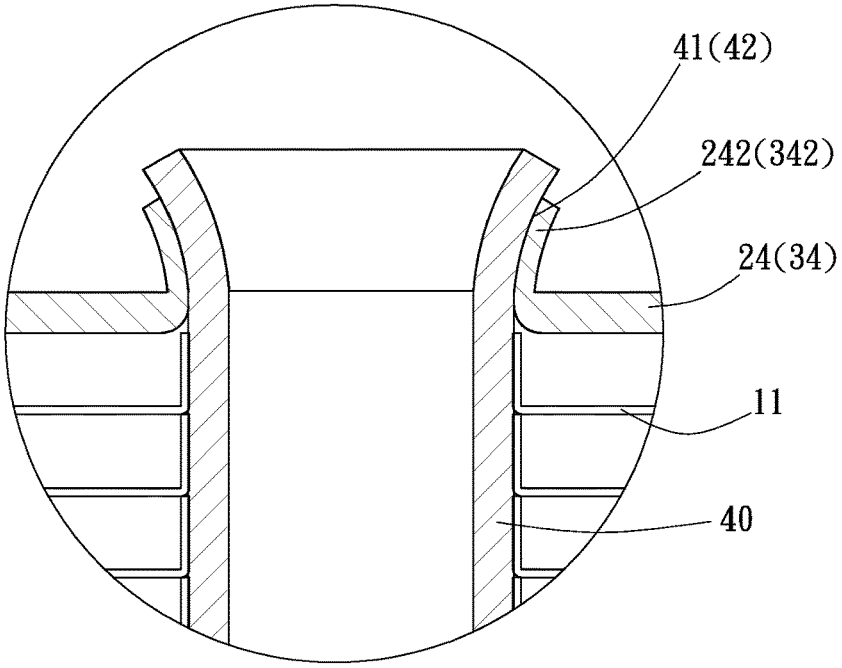
FIG. 7 corresponds to FIG. 6, illustrating the cooling heat dissipation pipe riveted to the packing panel.

Further, the top chamber 201 of the top cover 20 and the bottom chamber 301 of the bottom cover 30 are respectively sealed with a respective packing panel 24,34. The packing panels 24,34 are respectively mounted on the opposing ends of the liquid cooling heat dissipation pipes 40 and respectively affixed to the top cover 20 and the bottom cover 30 to seal the top chamber 201 and the bottom chamber 301. Each packing panel 24 or 34 comprises an upright flange 241 or 341 extended around the border thereof and press-fitted into the top chamber 201 or bottom chamber 301, and a plurality of peripherally raised pipe mounting holes 242 or 342 coupled to respective one ends of the liquid cooling heat dissipation pipes 40 (see FIG. 6). After insertion of the ends of the liquid cooling heat dissipation pipes 40 into the peripherally raised pipe mounting holes 242,342 of the packing panels 24,34, the opposite ends of the liquid cooling heat dissipation pipes 40 are respectively riveted into expanded holding-down portions 41,42 (see FIG. 7), and thus, the liquid cooling heat dissipation pipes 40 are respectively affixed to the pipe mounting holes 242,342. At this time, the top chamber 201 of the top cover 20, the bottom chamber 301 of the bottom cover 30 and the liquid cooling heat dissipation pipes 40 constitute an enclosed coolant circulating space.

Further, the liquid cooling heat dissipation pipes 40 are inserted through the radiation fin module 10 in a press-fit manner without any solder paste soldering process, therefore, no thermal resistance will occur.

As described above, the liquid cooling heat dissipation pipes 40 and the radiation fins 11 of the radiation fin module 10 are tightly coupled together. In terms of structure, the liquid cooling heat dissipation pipes 40 preferably have a circular or elliptical cross section. This structural design is more conducive to the riveting of the opposite ends of the liquid cooling heat dissipation pipes 40, enabling the opposing ends of the liquid cooling heat dissipation pipes 40 to be easily affixed to the packing panels 24,34. In terms of material, the liquid cooling heat dissipation pipes 40 are preferably copper pipes, aluminum pipes or other metal pipes that facilitate quick heat dissipation.

The wire gauge filter 50 can be selectively mounted in the flow passage of one respective liquid cooling heat dissipation pipe 40 on either the liquid inlet side (i.e. 40A) or liquid outlet side (i.e. 40B). In the application example shown in FIG. 5, individual wire gauge filters 50 are mounted at the respective outlet side liquid cooling heat dissipation pipes 40B and are directly disposed in communication with the bottom chamber 301. This application example is provided for reference only but not intended to limit the number and installation location of the at least one wire gauge filter 50.

Except the design of the aforesaid U-shaped semi-spherical plug, the configuration or material of the at least one wire gauge filter 50 can be changed without departing from the spirit of the present invention provided that the at least one wire gauge filter 50 can be individually installed in the flow passage of one respective liquid cooling heat dissipation pipe 40 at any desired location to effectively remove impurities.

Figure 8:
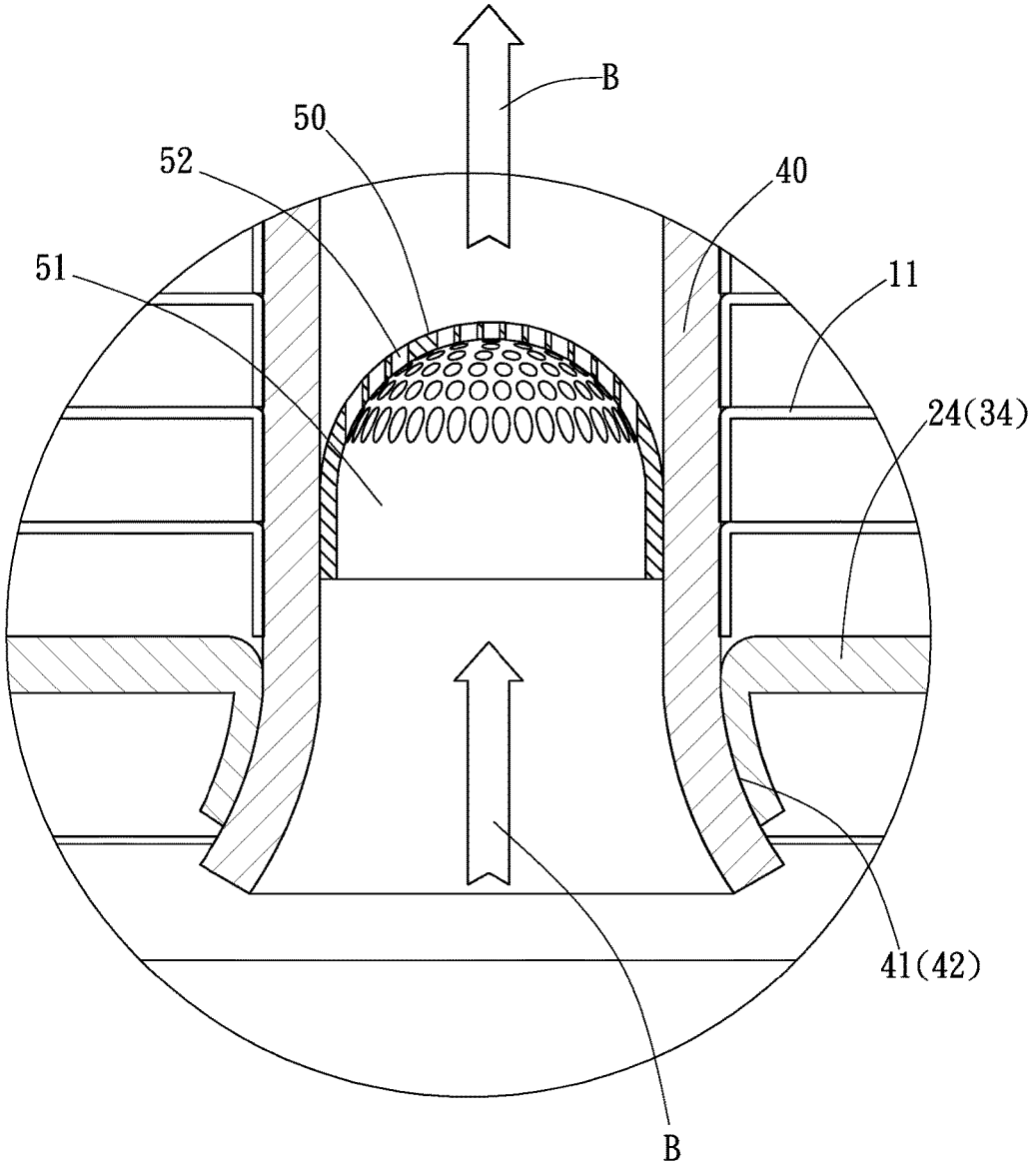
FIG. 8 is a schematic sectional view illustrating the wire gauge filter tightened up in the flow passage of the liquid cooling heat dissipation pipe.

Referring to FIG. 8, the U-shaped semi-spherical plug type wire gauge filter 50 curves inwardly, defining therein a miscellaneous liquid collecting chamber 51. Further, the top and middle portions of the wire gauge filter 50 are provided with a plurality of micro-filter holes 52. The micro-filter holes 52 allow liquid to slowly pass therethrough and trap impurities in the miscellaneous liquid collecting chamber 51, achieving the effect of slowing down the flow rate and removing impurities.

Further, the number, shape or diameter of the liquid cooling heat dissipation pipes 40 can be determined by the specifications of the liquid cooling radiator and the heat dissipation requirements without any limitation.

As shown in the drawings of the embodiment, the aforementioned radiation fin module 10 further comprises two frame pieces 12 respectively affixed to two opposite lateral sides of the radiation fins 11, and a bracket 13 fastened to each frame piece 12. Each bracket 13 has a plurality of lock holes 131 symmetrically provided at two opposite ends thereof for the mounting of a heat-dissipating fan (not shown).

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A liquid cooling radiator, comprising:

a radiation fin module comprising a plurality of radiation fins arranged in an array;

a top cover covering one end of said radiation fin module and defining with said radiation fin module an enclosed top chamber therebetween;

a partition plate mounted in said top cover to divide said top chamber into a liquid inlet chamber and a liquid outlet chamber;

a liquid inlet nozzle and a liquid outlet nozzle installed in said top cover and respectively disposed in communication with said liquid inlet chamber and said liquid outlet chamber for said liquid inlet nozzle to guide a coolant into said liquid inlet chamber and for said liquid outlet nozzle to guide the coolant out of said liquid outlet chamber;

a bottom cover covering an opposite end of said radiation fin module defining with said radiation fin module an enclosed bottom chamber therebetween;

a plurality of liquid cooling heat dissipation pipes tightly inserted through said radiation fin module, each said liquid cooling heat dissipation pipe having opposing top and bottom ends thereof respectively disposed in communication with said top chamber and said bottom chamber, wherein the plurality of liquid cooling heat pipes are arranged into two groups: inlet side liquid cooling heat dissipation pipes with the top ends thereof in communication with said liquid inlet chamber of said top chamber and outlet side liquid cooling heat dissipation pipes with the top ends thereof in communication with said liquid outlet chamber of said top chamber; and at least one wire gauge filter press-fitted in said liquid cooling heat dissipation pipes for removing solid matters from the coolant being circulated through said liquid inlet nozzle, said liquid inlet chamber, said inlet side liquid cooling heat dissipation pipes, said bottom chamber, said outlet side liquid cooling heat dissipation pipes, said liquid outlet chamber and said liquid outlet nozzle, and thereby slowing down the flowing speed of the circulating said coolant.

2. The liquid cooling radiator as claimed in claim 1, wherein each said wire gauge filter is in the form of a U-shaped semi-spherical plug.

3. The liquid cooling radiator as claimed in claim 2, wherein the U-shaped semi-spherical plug of each said wire gauge filter comprises a miscellaneous liquid collecting chamber therein and a plurality of micro-filter holes located on top and middle portions of a periphery thereof in communication with said miscellaneous liquid collecting chamber.

4. The liquid cooling radiator as claimed in claim 1, wherein each said wire gauge filter is mounted in one respective said outlet side liquid cooling heat dissipation pipe and directly disposed in communication with said bottom chamber.

5. The liquid cooling radiator as claimed in claim 1, further comprising a top packing panel and a bottom packing panel, said top packing panel comprising an upright flange extended around a periphery thereof and press-fitted into said top chamber and a plurality of raised pipe mounting holes disposed in communication with said top chamber, said bottom packing panel comprising an upright flange extended around a periphery thereof and press-fitted into said bottom chamber and a plurality of raised pipe mounting holes disposed in communication with said bottom chamber; wherein the top and bottom ends of said liquid cooling heat dissipation pipes are respectively inserted into said raised pipe mounting holes of said top packing panel and said raised pipe mounting holes of said bottom packing panel and respectively riveted into a respective expanded holding-down portion.

6. The liquid cooling radiator as claimed in claim 1, wherein said liquid cooling heat dissipation pipes are tightly inserted through said radiation fin module in a press-fit manner.

7. The liquid cooling radiator as claimed in claim 1, wherein said liquid cooling heat dissipation pipes are selectively configured to provide a circular or elliptical cross section.

8. The liquid cooling radiator as claimed in claim 1, wherein said radiation fin module further comprises two frame pieces respectively affixed to two opposite lateral sides of said radiation fins, and a bracket mounted to each said frame piece, each said bracket comprising a plurality of lock holes located at two opposite ends thereof.

* * * * *